US005536338A

United States Patent [19]

Metivier et al.

[11] Patent Number: 5,536,338

[45] Date of Patent: Jul. 16, 1996

[54] METHOD OF ANNEALING IRON-BASED PRODUCTS COMPRISED OF CARBON STEEL RICH IN CHROMIUM AND MANGANESE

[75] Inventors: Jean Metivier, Saint German En Laye; Hélène Chaudanson, Versailles; Jean Dhers, Saint Etienne, all of France

[73] Assignee: ASCOMETAL (Societe Anonyme), Puteaux, France

[21] Appl. No.: 354,095

[22] Filed: Dec. 6, 1994

[30] Foreign Application Priority Data

Dec. 13, 1993 [FR] France ..... 93 15138

[51] Int. Cl.[6] ..... C21D 1/76

[52] U.S. Cl. ..... 148/633; 148/596

[58] Field of Search ..... 148/596, 633

[56] References Cited

FOREIGN PATENT DOCUMENTS 59-150023 8/1984 Japan ..... 148/596

*Primary Examiner*—Deborah Yee

*Attorney, Agent, or Firm*—Sixbey, Friedman, Leedom & Ferguson

[57] ABSTRACT

A method of annealing of siderurgical products comprised of carbon steel having a chromium content in the range 0.15–1.5 wt. % and a manganese content also in the range 0.15–1.5 wt. %, whereby said products are held in an annealing furnace under nitrogen atmosphere to bring about globulization of the perlite; characterized in that oxygen is added to this atmosphere, in an amount greater than or equal to 0.5 vol. %.

6 Claims, No Drawings

METHOD OF ANNEALING IRON-BASED PRODUCTS COMPRISED OF CARBON STEEL RICH IN CHROMIUM AND MANGANESE

The invention relates to the area of technology of thermal treatment of steel alloys. In particular, it relates to the annealing of carbon steels rich in chromium and manganese.

Numerous uses exist for such steels. Examples of steels of this type are grade 38Cr4 (with c. 1% chromium and 0.6% manganese) and grade 100 C6 (with 1.7% chromium and 0.3% manganese). Examples of uses which might be mentioned are cold heading of screws and the like (in the case of 38Cr4) and the production of antifriction bearings (in the case of 100 C6).

Prior to final forming, the untreated hot-rolled steels of grade 38Cr4 may be subjected to the following treatments:

Generation of perlite globulization over a period of 20–26 hr by annealing of reels of wire of 1 ton [metric], at maximum temperature 770° C. in a nitrogen atmosphere with a dewpoint less than–50° C., followed by very slow cooling;

Pickling of the wire in a sulfuric acid or hydrochloric acid bath;

Phosphatization of the surface of the wire, in order to enable improved lubrication in the stage following the forming stage;

Forming, by wire-drawing, cold heading, or other cold pressing operation.

In industrial practice, one frequently encounters excessive wear of the forming tools (e.g. wire-drawing dies or pressing tools), due to irregular phosphatization over the periphery of the material, which itself is connected to nonuniform pickling of the wire, which is particularly a symptom of use of a sulfuric acid pickling medium.

Attempts have been made to remedy this problem by adjusting the conditions under which the pickling is carried out. The use of a hydrochloric acid medium, or, with a sulfuric acid medium, the use of potassium permanganate, ameliorates but does not eliminate the disadvantages under all circumstances. Also attempted without success has been holding of the reels in an atmosphere enriched in the vapors of the pickling solution. In addition, adjustment of the annealing parameters has been tried, with the aim of reducing formation of scale (which is supposed to be eliminated in the pickling operation). The thickness of the scale layer is on the order of 10 micron; it is formed during the steps preceding annealing as well as during the annealing step itself. Slight lowering of the annealing temperature to 760° C. does not give an appreciable improvement; and in any event the need to globulize the perlite militates against lowering the temperature, for the products in question. This need to globulize the perlite also prevents modification [i.e. reduction] of the duration of the annealing to any extent sufficient to significantly affect the aforesaid problem [of scale formation]. Laboratory tests have been conducted of annealing under a nitrogen/hydrogen or pure hydrogen reducing atmosphere, with the aim of eliminating any trace of oxygen which might contribute to the formation of scale by oxidation of the wire. But whereas such atmospheres are neutral or reducing for iron, under conditions of annealing in the presence of scale they are oxidizing for other elements such as silicon, manganese, or chromium, which is detrimental to the quality of the pickling. Moreover, the costs added by the use of such reducing atmospheres, and the safety hazards of hydrogen-containing atmospheres, make it difficult to employ such means in industrial production of the products in question.

The object of the present invention is a method of treating carbon steels rich in chromium and manganese, which ensures a good course of the phosphatization process, and which does not require burdensome modifications of the types of annealing and pickling currently practiced The principal claimed matter of the invention is a method of annealing of siderurgical products comprised of carbon steel having a chromium content in the range 0.15–1.5 wt. % and a manganese content also in the range 0.15–1.5 wt. %, whereby said products are held in an annealing furnace under nitrogen atmosphere to bring about globulization of the perlite; characterized in that oxygen is added to this atmosphere, in an amount greater than or equal to 0.5 vol. %.

As mentioned, the invention consists essentially of purposely increasing the oxygen content in the annealing atmosphere; this approach contradicts those previously proposed in the art. The metallurgical justification of this feature, which is intended to supersede the prior art, will be presented hereinbelow.

The present inventors studied the formation of scale on the surface of steels of grade 38Cr4. It was found that the scale which is present on the metal substrate at the outlet of the hot rolling step is a classical scale, comprised of various iron oxides slightly enriched in chromium at the metal-scale surface. The surface of the scale layer is essentially comprised of $Fe_2\mathbf{0}_3$, the internal part essentially of FeO, and a separation region between these two zones is comprised essentially of $Fe_3O_4$. This scale can be subjected to removal by pickling without particular problems. However, if the product coated with this scale is subjected to annealing for globulization under a nitrogen atmosphere (dewpoint–50° C.) at 770° C. for 26 hr, a major transformation of the scale is promoted. First of all, the surface layer of $Fe_2O_3$ disappears and the scale is only comprised of a mixture of FeO and $Fe_3O_4$ with $Fe_3O_4$ preponderant. Secondly, the greatest changes occur at the interface between the scale and the substrate. Passing from the exterior to the interior of the material, the following are encountered in succession:

The thick surface layer of FeO and $Fe_3O_4$ just mentioned supra, having thickness c. 10 micron;

A layer of reduced iron, which tends to separate from the material;

A third layer of thickness c. 1 micron, uniformly distributed over the substrate, comprised of iron, manganese, and chromium;

The substrate, comprising 38Cr4 steel.

Analyzing he said third layer by spectrometric methods, it was found that it is comprised of a mixture of spinals of the type $(Fe,Cr)_2O_4$ and $Mn_2O_4$, which were not present in the scale before the annealing. The presence of the intermediate layer comprising iron tends to show that the said spinels are formed during the annealing, in particular by reaction of the preexisting iron oxide layer with the metal substrate. This hypothesis is corroborated by the fact that the said spinels are present even if the annealing is carried out under a nitrogen-hydrogen atmosphere (thus totally free of oxygen); consequently the oxygen which forms the spinals must come principally from the layer of scale already present prior to the annealing. On the other hand, it turns out that this layer comprised of spinals is extremely adherent to the substrate, and pickling in a sulfuric acid medium cannot completely eliminate it. It represents an obstacle to homogeneous phosphatization of the substrate, which explains the problems of homogeneous wear of the tools encountered in connection with the forming of the material. These problems of pickling effectiveness are reduced if the pickling is carried out in a hydrochloric acid medium, but this technique is not applicable in all existing installations. As a result, there is a need to find operating conditions such that there is no promotion of the formation of a layer comprised of spinels during the operation of annealing.

The inventive concept consists of providing, during the annealing process, operating conditions such that the competition between the formation of classical scale based on iron oxides easily removable by pickling and spinels is shifted to favor the formation of the classical scale. This is accomplished by purposely imposing a substantial presence of gaseous oxygen in the annealing atmosphere. When this is done, one observes at the scale-substrate interface a progression of the front of iron oxides enriched to a greater or lesser degree with oxides of chromium, by reaction of the iron of the substrate with the gaseous oxygen. This reaction occurs at a rate greater than that which would characterize a solid-state reaction between the iron oxides and the iron, chromium, and manganese elements in the substrate, and therefore it suppresses the solid-state reaction.

Experience shows that introducing 0.5 vol. % oxygen to the nitrogen annealing atmosphere results in a significant decrease in the amount of spinal formed (compared to that formed under a pure nitrogen atmosphere), and a less adherent fragmented classical scale. For an oxygen content of 1.8 vol. % or more, it is found that the formation of spinels is completely inhibited, and the scale formed, which is less adherent, is easily removed in the subsequent pickling.

It is clear that the prevention of formation of spinels is more effective the greater the oxygen content of the atmosphere. Accordingly, one may even carry out the annealing in air. However, it is also clear that an exaggerated oxygen content may increase the scale formation to an intolerable degree, and waste a significant amount of the substrate. In addition to decreasing the yield, this can have the effect of rapidly fouling the furnace. There is also a risk of surface decarburation of the substrate. Experience shows that for a substrate comprising 38Cr4 steel an oxygen content of 1.8–3.5 vol. % does not result in unacceptable supplementary consumption of the substrate—a scale layer c. 10 micron thick prior to the annealing is increased to only 15 micron after 24 hr annealing at 770° C. Further, decarburation of the substrate is not observed.

Obviously, the applicability of the invention is not limited to the grades or types of steel mentioned; it may be used for any grade of carbon steel rich in chromium (0.15–1.5 wt. %) and manganese (0.15–1.5 wt. % which is susceptible to give rise to spinels which adhere to the metal-scale interface during annealing carried out in a neutral or reducing atmosphere. The temperature and duration of the annealing operation may vary as a function of the particular grade of steel, the form of the products treated, and the technology of the furnace. The essential features are that the annealing be set up as annealing for globulization of the perlite and be carried out in the prescribed atmosphere (nitrogen containing at least 0.5 vol. % oxygen), for iron-based products of a grade corresponding to the description immediately supra. As an illustration, such globulization annealing in industrial practice has a heating stage to a maximum temperature less than the Ac1 temperature of the steel, followed by very slow cooling and last between 12 and 30 hr.

We claim:

1. A method of annealing of iron-based products comprised of carbon steel having a chromium content in the range 0.15–1.5 wt. % and a manganese content also in the range of 0.15–1.5 wt. %, whereby said products are held in an annealing furnace under nitrogen atmosphere to bring about globalization of the perlite; comprising the step of adding oxygen to said atmosphere, in an amount greater than or equal to 0.5 vol. %.

2. A method according to claim 1; wherein said annealing comprises a stage of heating at a temperature less than the Ac1 temperature of the steel, followed by very slow cooking, and said annealing lasts between 12–30 hr.

3. A method according to claim 1, comprising the step of adding oxygen to the annealing atmosphere in an amount between about 0.5 vol. % and 21.0 vol. %.

4. A method according to claim 1, comprising the step of adding oxygen to the annealing atmosphere in an amount between about 1.8 vol. % and 3.5 vol. %.

5. A method of annealing of iron-based products of carbon steel having a chromium content in the range of 0.15–1.5 wt. % and a manganese content also in the range of 0.15–1.5 wt. %, whereby said products are held in an annealing furnace under a nitrogen atmosphere to bring about globalization of the perlite, comprising the step of adding between about 0.5 vol. % and 21 vol. % oxygen to the nitrogen atmosphere for preventing the formation of spinels that are adherent to the surface of said carbon steel.

6. A method of annealing according to claim 5, wherein said spinels include a mixture of the type $(Fe, Cr)_2O_4$.

* * * * *